US008672051B2

(12) United States Patent
Sakai

(10) Patent No.: US 8,672,051 B2
(45) Date of Patent: Mar. 18, 2014

(54) ELECTRIC HAMMER

(75) Inventor: Atsushi Sakai, Anjo (JP)

(73) Assignee: Makita Corporation, Anjo-Shi (JP)

( * ) Notice: Subject to any disclaimer, the term of this patent is extended or adjusted under 35 U.S.C. 154(b) by 214 days.

(21) Appl. No.: 13/202,700

(22) PCT Filed: Mar. 15, 2010

(86) PCT No.: PCT/JP2010/054299

§ 371 (c)(1),
(2), (4) Date: Aug. 22, 2011

(87) PCT Pub. No.: WO2010/110101

PCT Pub. Date: Sep. 30, 2010

(65) Prior Publication Data

US 2011/0297407 A1 Dec. 8, 2011

(30) Foreign Application Priority Data

Mar. 24, 2009 (JP) ..... 2009-072360

(51) Int. Cl.
*B25D 17/08* (2006.01)

(52) U.S. Cl.
USPC ..... 173/117; 173/200

(58) Field of Classification Search
USPC ..... 173/117, 162.1; 279/14, 19.4, 22, 60, 279/75, 905; 475/149
See application file for complete search history.

(56) References Cited

U.S. PATENT DOCUMENTS

| | | | | |
|---|---|---|---|---|
| 6,073,705 | A | 6/2000 | Shibata et al. | |
| 6,092,814 | A * | 7/2000 | Kageler | 279/19.4 |
| 2011/0100665 | A1 * | 5/2011 | Nakashima | 173/162.2 |

FOREIGN PATENT DOCUMENTS

| | | | |
|---|---|---|---|
| CN | 1317396 | A | 10/2001 |
| EP | 1 132 175 | A2 | 9/2001 |
| JP | A-2001-310271 | | 11/2001 |
| JP | A-2003-053682 | | 2/2003 |
| JP | A-2006-187836 | | 7/2006 |
| JP | A-2008-155369 | | 7/2008 |
| WO | WO 03/022531 | A1 | 3/2003 |
| WO | WO 2008/126481 | A1 | 10/2008 |

OTHER PUBLICATIONS

International Search Report mailed on Jun. 15, 2010 issued in International Patent Application No. PCT/JP2010/054299 (with translation).
Jul. 1, 2013 Search Report issued in European Patent Application No. 10755899.1.
Sep. 9, 2013 Chinese Office Action issued in Chinese Patent Application No. 201080013290.3.

* cited by examiner

*Primary Examiner* — Michelle Lopez
*Assistant Examiner* — Nathaniel Chukwurah
(74) *Attorney, Agent, or Firm* — Oliff PLC

(57) ABSTRACT

In an electric hammer, ridges are provided in an outer surface of a barrel, grooves are provided in an inner surface of a front cover, and rotation of the front cover with respect to the barrel is prevented by fitting the ridges in the grooves. A flange, which is latched on a stepped portion provided in front of the ridges and the grooves in the inner surface of the front cover, is provided in a peripheral edge of a lock ring, and forward movement of the front cover is restricted by latching the flange on the stepped portion.

14 Claims, 4 Drawing Sheets

ELECTRIC HAMMER

TECHNICAL FIELD

The present invention relates to an electric hammer that strikes a bit located at its tip end by a striking mechanism accommodated in a cylindrical barrel.

BACKGROUND ART

In electric hammers, a motor is accommodated in a rear housing, and a striking mechanism having a piston that reciprocates within a cylinder and a striking element that operates together with the piston via an air chamber is accommodated in a rear part of a cylindrical barrel coupled in front of the rear housing. A tool holder including at its front end a mount portion for a bit is shaft-supported in a front part of the barrel. Thus, when the piston reciprocates by driving of the motor, the striking element reciprocates together with the piston due to the action of an air spring, thereby striking the bit mounted to the tool holder, either directly or indirectly via an intermediate element (see, e.g., Patent Document 1).

Such electric hammers are sometimes provided with an angle adjustment mechanism capable of arbitrarily adjusting an angle about the axis of the bit. In this angle adjustment mechanism, the tool holder is rotatably provided, a change ring is mounted on the outer periphery of the tool holder so as to be rotatable together with the tool holder, and to be slidable in an axial direction, and a lock ring having a cam face that engages with the change ring is non-rotatably mounted behind the change ring on the tool holder. In a normal state, the change ring is moved rearward by biasing means such as a coil spring to a position where the change ring engages with the lock ring, whereby the angle of the tool holder and the bit is fixed. On the other hand, when the change ring is moved forward against the biasing means to disengage the change ring from the lock ring, the tool holder and the bit are allowed to rotate to any angle by rotation of the change ring.

RELATED ART DOCUMENT

Patent Document

[Patent Document 1] Japanese Patent Application Publication No. JP-A-2008-155369

SUMMARY OF THE INVENTION

Problem to be Solved by the Invention

The barrel is made of a metal such as aluminum. Thus, if the barrel is directly held by hand, heat that is generated during a striking operation is conducted to the hand, which degrades usability. Accordingly, a barrel cover made of a synthetic resin is mounted on the barrel. This barrel cover has its rear end screwed to the rear housing, and has its front end engaging with a front-side part such as a change ring cover provided on the change ring. Thus, when separating the barrel from the rear housing to repair the striking mechanism inside the barrel, to replace a part, etc., the front-side part such as the change ring cover, the mount portion, etc. need first be disassembled and removed in order to remove the barrel cover from the barrel. Accordingly, it takes a lot of time and labor to carry out disassembly and assembly associated with repair, etc. As a solution, a structure has also been employed in which the barrel cover is divided into two parts, namely a front cover that is mounted on a front part of the barrel and a rear cover that is mounted on a rear part of the barrel, so that only the rear cover can be attached and detached. However, this structure requires an additional structure to rotate the front cover and to fix the front cover in a longitudinal direction, thereby complicating the structure and increasing the cost.

It is therefore an object of the present invention to provide an electric hammer capable of fixing a front cover in a simple and reasonable manner in a structure in which a barrel cover is divided into front and rear covers.

Means for Solving the Problem

In order to achieve the above object, an embodiment is an electric hammer, in which a cylindrical barrel is coupled to a rear housing accommodating a motor. A tool holder including at a tip end thereof a mount portion for a bit is coaxially and rotatably held in a front end of the barrel. A striking mechanism that strikes the bit by driving of the motor is accommodated in a rear part of the barrel. A change ring, which is capable of rotating together with the tool holder and capable of moving in a longitudinal direction and whose rotation and movement are controllable from outside, and a lock ring, which is provided between the change ring and the barrel and which engages with the change ring at a rearward position of the change ring to restrict the rotation of the change ring, are mounted behind the mount portion on the tool holder, and a cylindrical front cover that covers a front part of the barrel, and a cylindrical rear cover that covers a rear part of the barrel and that is assembled to the rear housing are mounted on the barrel. Furthermore, a ridge is provided in one of an outer surface of the barrel and an inner surface of the front cover so as to extend rearward from a front end, and a groove in which the ridge is fitted is provided in the other surface, so that rotation of the front cover with respect to the barrel is prevented by fitting the ridge in the groove. A latch portion, which is latched on a latched portion that is provided in front of the ridge and the groove in the inner surface of the front cover, is provided in a peripheral edge of the lock ring, so that forward movement of the front cover is restricted by latching the latch portion on the latched portion.

In an embodiment an inner diameter of the rear cover is made larger than a diameter of each constituent part that is located in front of the rear cover, so that the rear cover can be independently attached to and detached from a front side.

In an embodiment in a case where an attachment portion of a side handle is mounted on the front cover, a portion where the ridge is fitted in the groove adjoins or overlaps in the longitudinal direction a position where the attachment portion is mounted.

In an embodiment an axial length of the front cover is set to such a length that does not interfere with attachment and detachment of a coupling tool that couples the barrel to the rear housing.

In an embodiment a rear end of the front cover is made to overlap a front end of the rear cover, and a seal member that seals the overlapping portion is provided in one of the front cover and the rear cover.

Effects of the Invention

In an embodiment, the front cover can be positioned in a simple and reasonable manner by using the existing barrel and lock ring.

In an embodiment, if a part within the barrel such as the striking mechanism need to be replaced or repaired, the barrel can be easily separated from the rear housing by removing only the rear cover without disassembling the mount portion, etc. located on the front side. Accordingly, satisfactory workability associated with repair and maintenance can be implemented.

In an embodiment, the front cover becomes more integral with the barrel by a tightening force of the attachment portion of the side handle, whereby fixing of the front cover becomes more reliable.

In an embodiment, independent attachment and detachment of the rear cover can be smoothly performed, whereby further improvement in workability associated with repair, etc. can be expected.

In an embodiment, a preferable sealing property can be maintained even if a barrel cover is divided into the front and rear covers.

DESCRIPTION OF EMBODIMENTS

An embodiment of the present invention will be described below with reference to the accompanying drawings.

Figure 1:
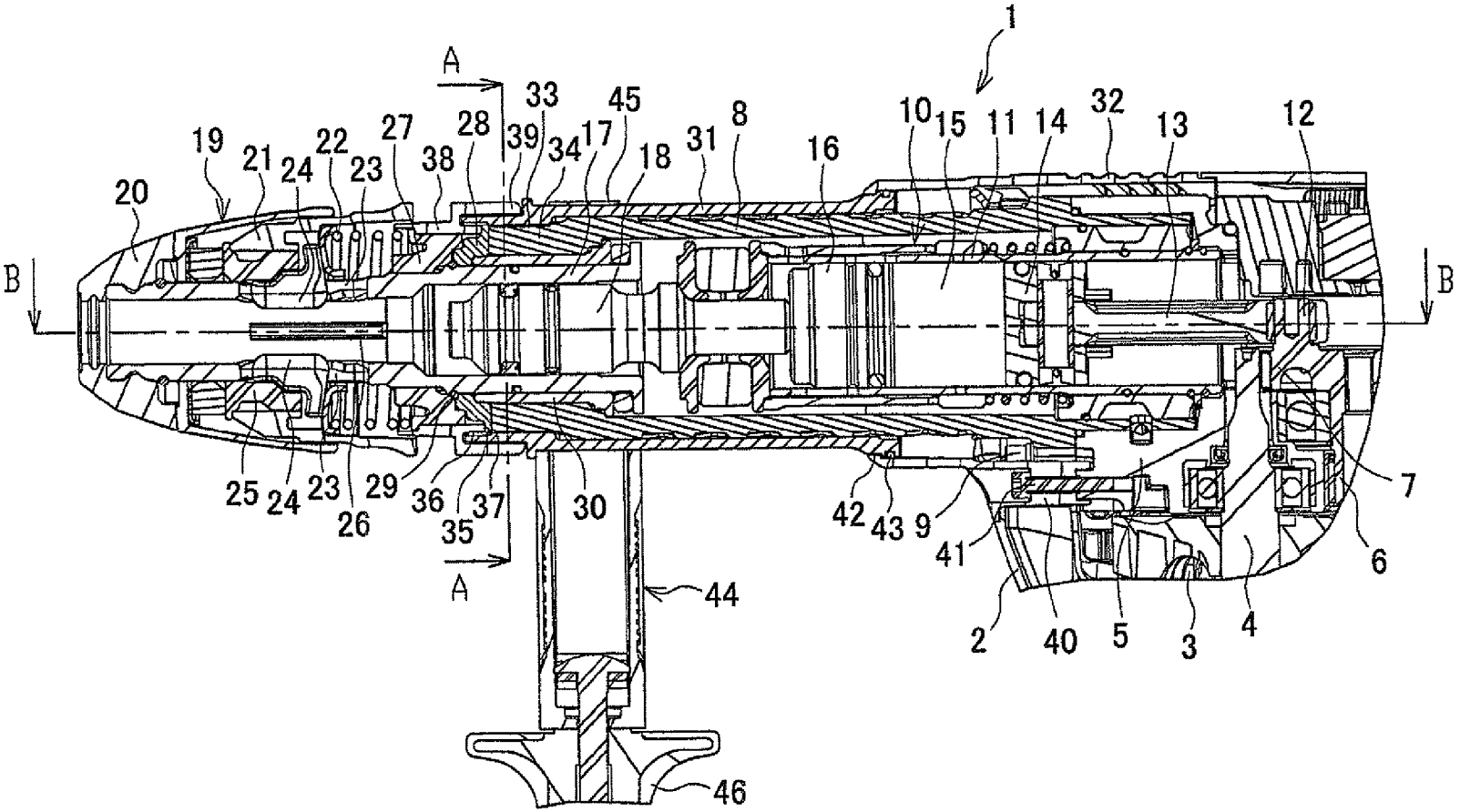
FIG. 1 is a partial longitudinal cross-sectional view of an electric hammer.

FIG. 1 is a partial longitudinal cross-sectional view showing an example of an electric hammer. An electric hammer 1 accommodates a motor 3 in a rear (on the right side in FIG. 1) motor housing 2, and has an output shaft 4 protruding into a crank housing 5 assembled above the motor 3 to the motor housing 2. The motor housing 2 and the crank housing 5 serve as a rear housing of the present invention.

In the crank housing 5, a crankshaft 6 including a gear 7 with which the output shaft 4 meshes is shaft-supported parallel to the output shaft 4. A cylindrical barrel 8 is coupled in front of the crank housing 5 in a direction perpendicular to the output shaft 4 by a plurality of screws 9 as a coupling tool, and a striking mechanism 10 is accommodated in the barrel 8.

The striking mechanism 10 includes a cylinder 11, a piston 14, a striking element 16, and an intermediate element 18. The cylinder 11 is coaxially held in a rear part of the barrel 8. The piston 14 is accommodated in the cylinder 11 so as to be movable in a longitudinal direction, and that is coupled via a connecting rod 13 to an eccentric pin 12 provided in a protruding manner in an upper surface of the crankshaft 6. The striking element 16 is accommodated in front of the piston 14 in the cylinder 11, and that operates together with the piston 14 via an air chamber 15. The intermediate element 18 that is accommodated in a rear part of a cylindrical tool holder 17, which is rotatably held in a front end of the barrel 8, so as to be movable in the longitudinal direction.

On the other hand, a mount portion 19 for a bit is provided on a front part of the tool holder 17, which protrudes from the barrel 8. The mount portion 19 includes a cap 20, an operation sleeve 21, a coil spring 22, a pair of pressing bodies 24, 24, and a guide ring 25. The cap 20 is fitted on a front end of the tool holder 17. An operation sleeve 21 is mounted behind the cap 20 over the tool holder 17 so as to be movable in the longitudinal direction. The coil spring 22 that biases the operation sleeve 21 forward. The pair of pressing bodies 24, 24 that are accommodated so as to be able to protrude toward and retract from the axial center of the tool holder 17 from a longitudinal long hole 23 provided in the tool holder 17, and that follow the longitudinal movement of the operation sleeve 21 and the guide ring 25 that is located in front of the pressing bodies 24, and that guides the pressing bodies 24 to the protruding position toward the axial center of the tool holder 17 when the operation sleeve 21 is located at a forward position.

A pair of ridges 26, 26, which are to be fitted in grooves formed in the outer periphery of a rear end of the bit, not shown, are provided in an axial direction in an inner surface of the tool holder 17.

Thus, in a state in which the operation sleeve 21 is moved rearward against biasing of the coil spring 22, and the pressure of the pressing bodies 24 is removed, the rear end of the bit is inserted into the tool holder 17 with the ridges 26 being aligned in phase with the grooves, and the operation sleeve 21 is moved forward again. As a result, the pressing bodies 24, 24 protruding toward the axial center of the tool holder 17 are fitted into a recess provided at the rear end of the bit, whereby the bit is prevented from coming off. Moreover, the ridges 26 are fitted in the grooves, whereby rotation of the bit is prevented.

Figure 3:
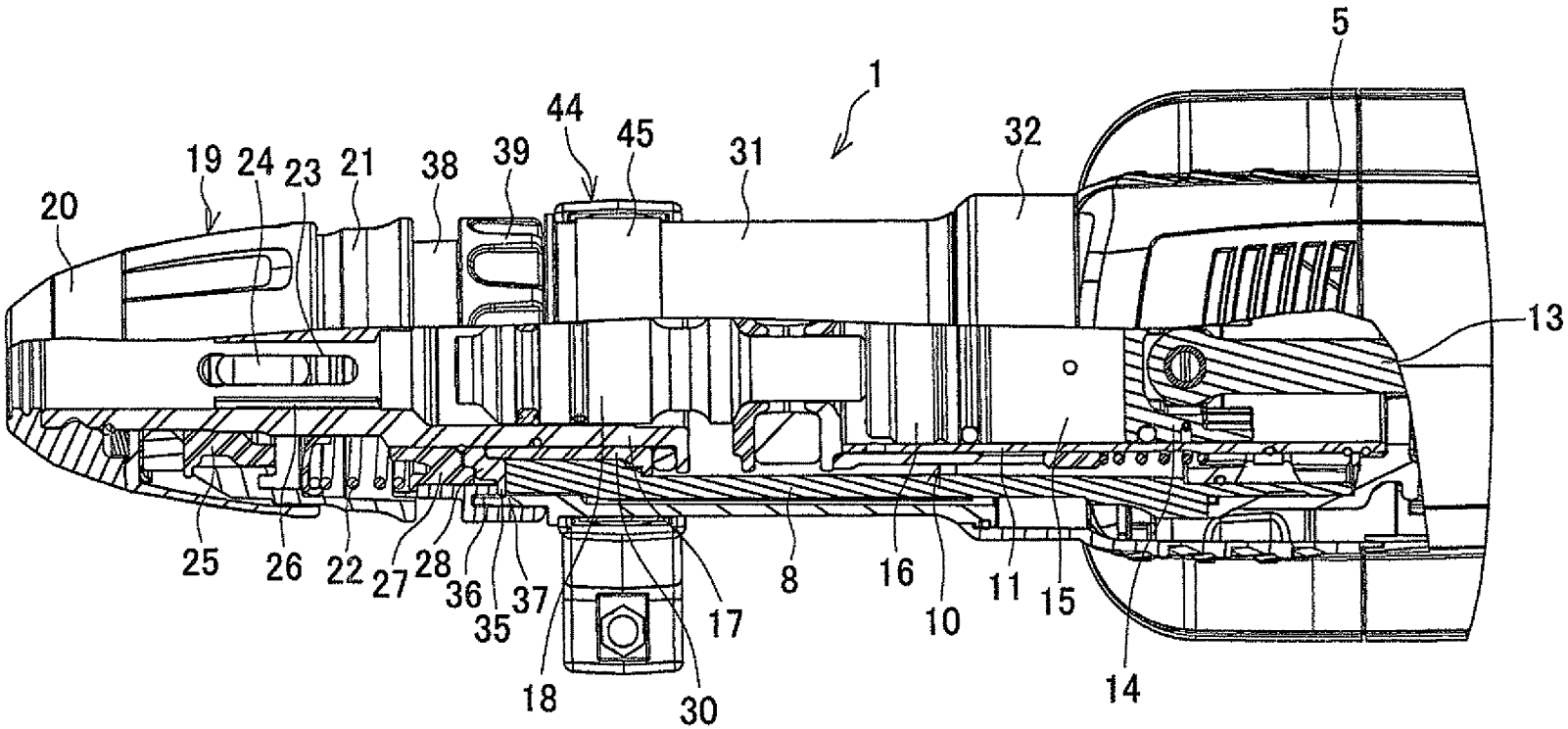
FIG. 3 is a cross-sectional view taken along line B-B.
Figure 4:
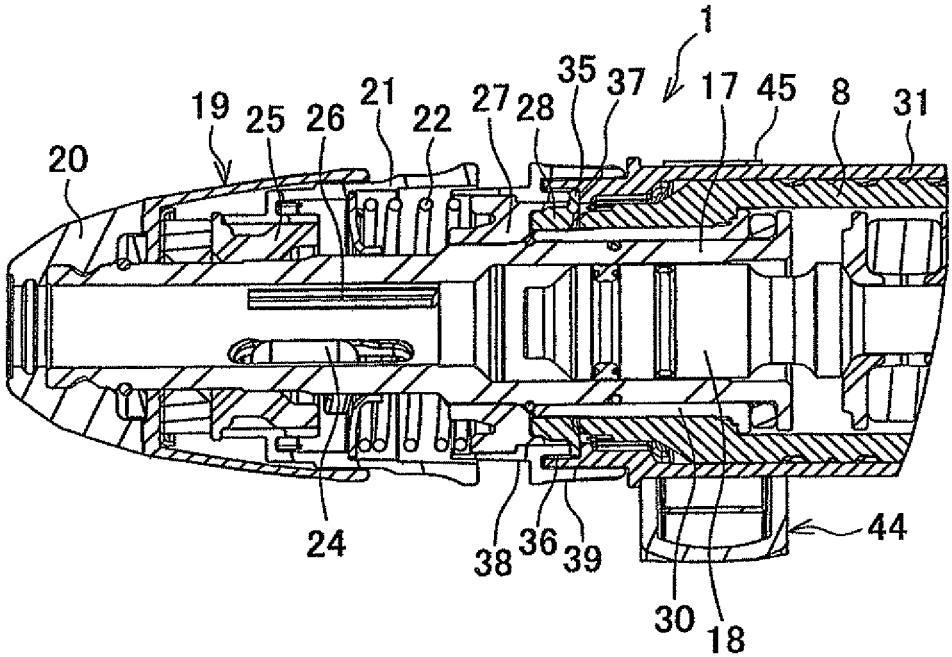
FIG. 4 is a cross-sectional view taken along line C-C.

As also shown in FIGS. 3 and 4, a change ring 27 and a lock ring 28 are further mounted behind the coil spring 22 on the tool holder 17. The change ring 27 is spline-coupled to the tool holder 17 so as to be movable in the longitudinal direction. In a normal state, the change ring 27 is biased by the coil spring 22 to a rearward position where the change ring 27 contacts the lock ring 28.

The lock ring 28 is non-rotatably fixed between a ring spring 29 on the outer periphery of the tool holder 17, and a tool holder guide 30 that is held in the front end of the barrel 8, so that rotation of the change ring 27 that is biased to the rearward position is restricted by engagement between cam faces, not shown, that are respectively formed in opposing surfaces of the lock ring 28 and the change ring 27. The lock ring 28 is made of iron, and engagement and disengagement between the barrel 8 made of aluminum and the change ring 27 made of iron causes wear on the barrel 8. Thus, the lock ring 28 is interposed between the barrel 8 and the change ring 27 so as not to cause wear on the barrel 8.

A cylindrical front cover 31 that covers a front part of the barrel 8, and a cylindrical rear cover 32 that covers the rear part of the barrel 8 and that has a larger diameter than the front cover 31, are mounted on the barrel 8. Both of the covers 31, 32 are made of a synthetic resin.

Figure 2:
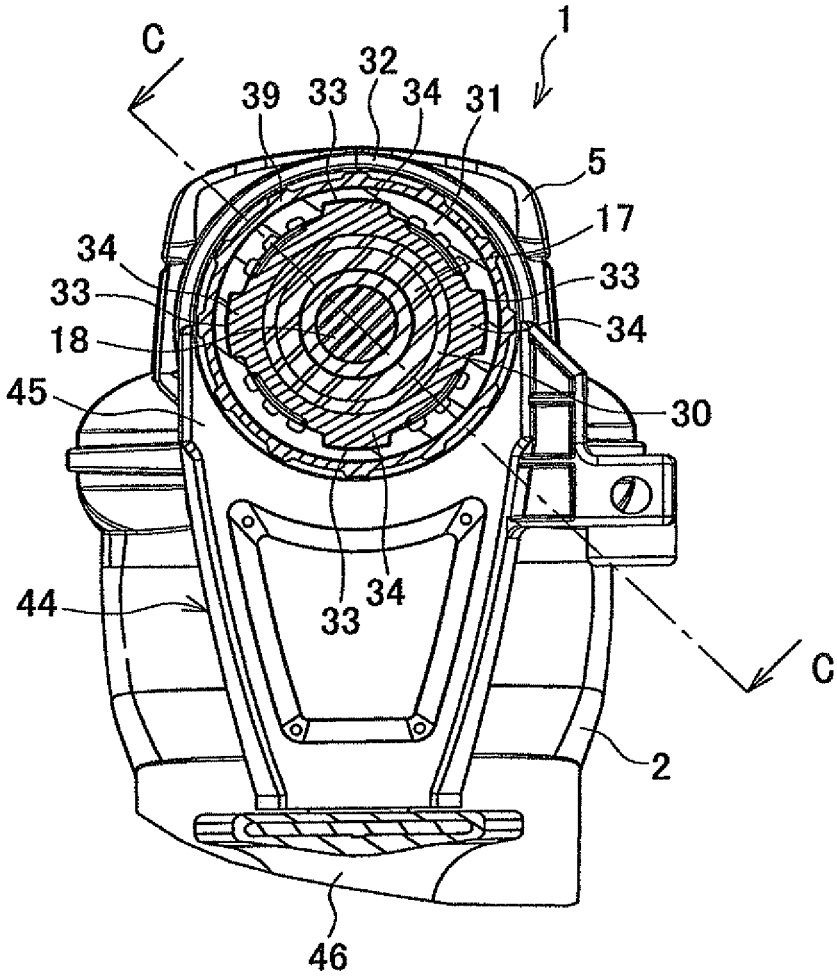
FIG. 2 is a cross-sectional view taken along line A-A.

As also shown in FIG. 2, four grooves 33, 33, . . . are formed at regular intervals in a circumferential direction in an inner surface of the front cover 31 so as to extend rearward from a front end of the front cover 31, and four ridges 34, 34, . . . corresponding to the grooves 33 are provided in the outer surface of the barrel 8 so as to extend rearward from the front end of the barrel 8. Thus, by mounting the front cover 31 on the barrel 8 with the grooves 33 aligned in phase with the ridges 34, the ridges 34 are fitted in the grooves 33, whereby rotation of the front cover 31 is prevented.

A fitting hole 36, in which a flange 35 as a latch portion provided along the outer periphery of the lock ring 28 is fitted, is formed in the inner periphery of the front end of the front cover 31. The fitting hole 36 is formed in front of the grooves 33, and has a larger diameter than a concentric circle including the bottom of each groove 33. A stepped portion 37 as a latched portion on which the flange 35 is latched is formed between the fitting hole 36 and the grooves 33. Reference numeral "38" represents a change ring cover that is integrally mounted on the change ring 27 so that a flange portion 39 at a rear end of the change ring cover 38 covers the front end of the front cover 31.

The rear cover 32 has a joint portion 40 provided at its rear end, and the joint portion 40 is fixed to the crank housing 5 by a screw 41. The rear cover 32 also has a hook portion 42 formed at its front end, and the hook portion 42 overlaps a rear end of the front cover 31 from outside and is hooked on the rear end of the front cover 31. Thus, the rear cover 32 covers the rear part of the barrel 8 from outside the screws 9. A portion of the front cover 31 which overlaps the rear cover 32 is provided with an O-ring 43 as a seal member that is pressed against an inner surface of the rear cover 32 in the state in which the rear cover 32 is fixed.

In this example, all of front-side parts located in front of the rear cover 32, such as the front cover 31, the change ring cover 38, the operation sleeve 21, and the cap 20, have a diameter smaller than the inner diameter of the rear cover 32. Thus, by removing the screw 41 to disconnect the rear cover 32 from the crank housing 5, the rear cover 32 can be independently moved forward and removed from a tip end of the electric hammer 1 without removing the barrel 8 and the mount portion 19.

Reference numeral "44" represents a detachable side handle, which has an attachment portion 45 that is mounted on the front cover 31, and a grip portion 46 that is coupled to the attachment portion 45. The grip portion 46 is provided so as to protrude perpendicularly from the axial center of the barrel 8 and the tool holder 17. The position where the attachment portion 45 of the side handle 44 is mounted is located behind and adjacent to the portion where the ridges 34 are fitted in the grooves 33 to prevent rotation of the front cover 31.

The electric hammer 1 configured as described above is assembled by the following procedures.

First, the front cover 31 is mounted on the barrel 8, and the tool holder 17 is inserted from the rear of the barrel 8 so as to be held by the tool holder guide 30. Next, the lock ring 28, the change ring 27, the change ring cover 38, and the mount portion 19 are assembled to the tool holder 17 protruding beyond the barrel 8. Then, the striking mechanism 10 (since the piston 14 is coupled to the side of the crankshaft 6 by the connecting rod 13, the piston 14 is later inserted into the cylinder 11) is assembled from the rear of the barrel 8, and the barrel 8 is fastened by the screws 9 to the crank housing 5 having the motor housing 2 assembled thereto.

In this example, since the axial length of the front cover 31 is set so that a stroke that allows the screws 9 to be tightened from the front side is secured behind the front cover 31, that is, so that the front cover 31 does not interfere with attachment and detachment of the screws 9, assembly of the barrel 8 is not hindered.

With the barrel 8 being assembled in this manner, the ridges 34 are fitted in the grooves 33, whereby rotation of the front cover 31 with respect to the barrel 8 is prevented, and rearward movement of the front cover 31 is restricted. At the same time, the lock ring 28 is assembled and thus the flange 35 contacts the stepped portion 37, whereby forward movement of the front cover 31 is restricted (the front cover 31 is prevented from coming off).

Then, the rear cover 32 is mounted from the front side, and is slid rearward to hook the hook portion 42 on the rear end of the front cover 31, and the joint portion 40 is coupled to the crank housing 5 by the screw 41. Thus, assembly of the electric hammer 1 is completed.

In this electric hammer 1, when the motor 3 is driven by operating a switch, not shown, and the output shaft 4 is rotated, the crankshaft 6 is rotated to convert circular motion of the eccentric pin 12 to reciprocating motion of the piston 14 via the connecting rod 13. Thus, the striking element 16 reciprocates together with the piston 14 due to the action of an air spring in the air chamber 15. In the state in which the bit is inserted and mounted in the tool holder 17, the rear end of the bit moves the intermediate element 18 rearward to cause a rear end of the intermediate element 18 to protrude into the cylinder 11. Thus, the intermediate element 18 is continuously struck by the reciprocating striking element 16, whereby the bit is also struck accordingly.

When it is desired to change the angle about the axis of the bit, the change ring cover 39 and the change ring 27 are moved forward by holding the flange portion 39 of the change ring cover 38. Thus, the change ring 27 is separated from the lock ring 28, and restriction of rotation is eliminated, whereby the tool holder 17 is allowed to rotate freely. Accordingly, the angle of the bit together with the tool holder 17 can be arbitrarily changed by rotating the change ring cover 38 in this state. After the angle is determined, the change ring cover 38 is moved rearward, whereby the change ring 27 is also moved rearward to engage with the lock ring 28 again. Thus, the tool holder 17 and the bit are fixed together at this angle.

As described above, according to the electric hammer 1 of the above embodiment, the ridges 34 are provided in the outer surface of the barrel 8, the grooves 33 are provided in the inner surface of the front cover 31, and rotation of the front cover 31 with respect to the barrel 8 is prevented by fitting the ridges 34 in the grooves 33. Moreover, the flange 35, which is latched on the stepped portion 37 that is provided in front of the ridges 34 and the grooves 33 in the inner surface of the front cover 31, is provided in the peripheral edge of the lock ring 28, and forward movement of the front cover 31 is restricted by latching the flange 35 on the stepped portion 37. Thus, the front cover 31 can be fixed in a simple and reasonable manner by using the existing barrel 8 and lock ring 28.

In particular, in this example, the inner diameter of the rear cover 32 is made larger than the diameter of each constituent part located in front of the rear cover 32, such as the front cover 31 and the mount portion 19, so that the rear cover 32 can be independently attached and detached from the front side. Thus, if a part within the barrel 8 such as the striking mechanism 10 needs to be replaced or repaired, the barrel 8 can be easily separated from the crank housing 5 by removing only the rear cover 32 without disassembling the mount portion 19, etc. located on the front side. Accordingly, satisfactory workability associated with repair and maintenance can be implemented.

Since the portion where the ridges 34 are fitted in the grooves 33 adjoins in the longitudinal direction the position where the attachment portion 45 of the side handle 44 is mounted, the front cover 31 becomes more integral with the barrel 8 by the tightening force of the attachment portion 45, whereby fixing of the front cover 31 becomes more reliable.

Moreover, since the axial length of the front cover 31 is set to such a length that does not interfere with attachment and detachment of the screws 9 that couple the barrel 8 to the crank housing 5, independent attachment and detachment of the rear cover 32 can be smoothly performed, whereby further improvement in workability associated with repair, etc. can be expected.

The rear end of the front cover 31 is made to overlap the front end of the rear cover 32, and the front cover 31 is provided with the O-ring 43 that seals the overlapping portion with the rear cover 32. Thus, a preferable sealing property can be maintained even if a cover for the barrel 8 is divided into the front and rear covers 31, 32.

In the above embodiment, the grooves are provided in the front cover, and the ridges are provided in the barrel. However, the ridges may be provided in the front cover, and the grooves may be provided in the barrel. It should be noted that the respective numbers of grooves and ridges, and the respective shapes thereof can be changed as appropriate.

The latch portion of the lock ring is not limited to the flange, and may be a plurality of protrusions provided in a radial pattern, the latched portion provided for the barrel may be a recess portion corresponding to each of the protrusions, etc. That is, other structures can be employed as long as the barrel can be prevented from coming off.

Moreover, in the above embodiment, the rear cover has a cylindrical shape. However, the rear cover may be divided into right and left halves, and these halves may be assembled. It should be noted that as for the seal member as well, the number of seal members, and the shape and type thereof may be changed. The seal member may be omitted depending on the structure in which the front and rear covers are assembled.

The positional relation between the portion where the ridges are fitted in the grooves in the front cover and the barrel and the attachment portion of the side handle is not limited to the relation in which the fitting portion adjoins the attachment portion. The fitting portion and the attachment portion may be provided so as to partially or entirely overlap each other.

In addition, the structures of the striking mechanism and the mount portion, etc. can be changed as appropriate.

DESCRIPTION OF THE REFERENCE NUMERALS

1 . . . electric hammer; 2 . . . motor housing; 3 . . . motor; 4 . . . output shaft; 5 . . . crank housing; 6 . . . crankshaft; 8 . . . barrel; 9, 41 . . . screw; 10 . . . striking mechanism; 11 . . . cylinder; 14 . . . piston; 16 . . . striking element; 17 . . . tool holder; 18 . . . intermediate element; 19 . . . mount portion; 21 . . . operation sleeve; 22 . . . coil spring; 27 . . . change ring; 28 . . . lock ring; 31 . . . front cover; 32 . . . rear cover; 33 . . . groove; 34 . . . ridge; 35 . . . flange; 37 . . . stepped portion; 42 . . . hook portion; 43 . . . O-ring; 44 . . . side handle; and 45 . . . attachment portion

The invention claimed is:

1. An electric hammer comprising:

a rear housing;

a cylindrical barrel coupled to the rear housing, the cylindrical barrel having a rear part and a front part;

a motor located in the rear part of the cylindrical barrel, a tool holder including at a tip end thereof a mount portion for a bit, the tool holder being coaxially and rotatably held in a front part of the cylindrical barrel; and able to move in a longitudinal direction a striking mechanism located in the rear part of the cylindrical barrel that strikes the bit by driving the motor a change ring disposed between the mount portion and the tool holder, the change ring being capable of rotating together with the tool holder and moving in a longitudinal direction and whose rotation and longitudinal movement are controllable from outside, a lock ring located between the change ring and the cylindrical barrel which engages the change ring at a rearward position of the change ring to restrict the rotation of the change ring a cylindrical front cover mounted on and covering a front part of the cylindrical barrel a cylindrical rear cover mounted on and covering the rear part of the cylindrical barrel, the cylindrical rear cover being assembled to the rear housing wherein a ridge is provided in one of an outer surface of the cylindrical barrel and an inner surface of the cylindrical front cover the ridge extending rearward from the front end of the cylindrical barrel, and a groove defined by one of the outer surface and the inner surface into which the ridge is fitted to substantially prevent rotation of the front cover with respect to the barrel the inner surface of the cylindrical front cover defining a latch portion between the mount portion and the ridge at a peripheral edge of the lock ring, wherein the latch portion is structured to restrict forward movement of the front cover.

2. The electric hammer according to claim 1, wherein an inner diameter of the cylindrical rear cover is larger than a diameter of each constituent part that is located in front of the cylindrical rear cover, so that the cylindrical rear cover can be independently attached and detached from a front side.

3. The electric hammer according to claim 2, wherein an axial length of the cylindrical front cover is set to such a length that the axial length of the cylindrical front cover does not interfere with attachment or detachment of a coupling tool from a front side of the cylindrical front cover that couples the cylindrical barrel to the rear housing.

4. The electric hammer according to claim 3, wherein a rear end of the cylindrical front cover is to overlap a front end of the cylindrical rear cover, and a seal member that seals the overlapping portion is provided in one of the cylindrical front cover and the cylindrical rear cover.

5. The electric hammer according to claim 2, wherein an attachment portion of a detachable side handle is mounted on the cylindrical front cover, behind and adjacent to a portion of the cylindrical front cover where the ridge is fitted in the groove to prevent rotation of the cylindrical front cover.

6. The electric hammer according to claim 5, wherein an axial length of the cylindrical front cover is set to such a length that the axial length of the cylindrical front cover does not interfere with attachment or detachment of a coupling tool from a front side of the cylindrical front cover that couples the cylindrical barrel to the rear housing.

7. The electric hammer according to claim 6, wherein a rear end of the cylindrical front cover is to overlap a front end of the cylindrical rear cover, and a seal member that seals the overlapping portion is provided in one of the cylindrical front cover and the cylindrical rear cover.

8. The electric hammer according to claim 5, wherein a rear end of the cylindrical front cover is to overlap a front end of the cylindrical rear cover, and a seal member that seals the overlapping portion is provided in one of the cylindrical front cover and the cylindrical rear cover.

9. The electric hammer according to claim 2, wherein a rear end of the cylindrical front cover is to overlap a front end of the cylindrical rear cover, and a seal member that seals the overlapping portion is provided in one of the cylindrical front cover and the cylindrical rear cover.

10. The electric hammer according to claim 1, wherein an attachment portion of a detachable side handle is mounted on the cylindrical front cover, behind and adjacent to a portion of the cylindrical front cover where the ridge is fitted in the groove to prevent rotation of the cylindrical front cover.

11. The electric hammer according to claim 10, wherein an axial length of the cylindrical front cover is set to such a length that the axial length of the cylindrical front cover does not interfere with attachment or detachment of a coupling tool from a front side of the cylindrical front cover that couples the cylindrical barrel to the rear housing.

12. The electric hammer according to claim 11, wherein a rear end of the cylindrical front cover is to overlap a front end of the cylindrical rear cover, and a seal member that seals the overlapping portion is provided in one of the cylindrical front cover and the cylindrical rear cover.

13. The electric hammer according to claim 10, wherein a rear end of the cylindrical front cover is to overlap a front end of the cylindrical rear cover, and a seal member that seals the overlapping portion is provided in one of the cylindrical front cover and the cylindrical rear cover.

14. The electric hammer according to claim 1, wherein a rear end of the cylindrical front cover is made to overlap a front end of the cylindrical rear cover, and a seal member that seals the overlapping portion is provided in one of the cylindrical front cover and the cylindrical rear cover.

* * * * *